United States Patent [19]

Kawamoto et al.

[11] Patent Number: 4,704,074

[45] Date of Patent: Nov. 3, 1987

[54] TURBOCHARGER FOR INTERNAL COMBUSTION ENGINE

[75] Inventors: Hiroshi Kawamoto; Hiroshi Miyazaki, both of Toyota, Japan

[73] Assignee: Toyota Jidosha Kabushiki Kaisha, Aichi, Japan

[21] Appl. No.: 743,083

[22] Filed: Jun. 10, 1985

[30] Foreign Application Priority Data

Jun. 13, 1984 [JP] Japan ..... 59-86631[U]

[51] Int. Cl.[4] ..... F04B 17/00

[52] U.S. Cl. ..... 417/407; 416/244 A; 416/241 B; 403/30; 403/273

[58] Field of Search ..... 417/407; 416/244 A, 416/241 B; 403/29, 30, 41, 179, 273; 228/903

[56] References Cited

U.S. PATENT DOCUMENTS

| | | | |
|---|---|---|---|
| 1,940,870 | 12/1933 | Litton | 403/29 |
| 2,297,508 | 9/1942 | Schutte | 416/241 B |
| 3,321,565 | 5/1967 | Peterson et al. . | |
| 3,604,819 | 3/1971 | Krabe et al. . | |
| 3,666,302 | 5/1972 | Kellett . | |
| 3,801,226 | 5/1974 | Bevan et al. . | |
| 4,123,199 | 8/1978 | Shimizu et al. | 416/241 B |
| 4,176,519 | 12/1979 | Kronugard | 416/244 A |
| 4,214,906 | 7/1980 | Langer et al. . | |
| 4,270,330 | 6/1981 | Gulati et al. . | |
| 4,279,576 | 7/1981 | Okano et al. . | |
| 4,281,941 | 8/1981 | Rothenkolber | 416/244 A |
| 4,325,647 | 4/1982 | Maier et al. | 403/29 |
| 4,404,935 | 10/1983 | Kraft . | |
| 4,424,003 | 1/1984 | Brobeck | 416/244 A |
| 4,479,293 | 6/1984 | Miller et al. . | |
| 4,479,735 | 4/1934 | Thompson et al. . | |
| 4,492,737 | 1/1985 | Conolly . | |
| 4,495,684 | 1/1985 | Sander et al. . | |
| 4,503,009 | 3/1985 | Asaka . | |
| 4,518,315 | 5/1985 | Kruger | 416/244 A |
| 4,531,269 | 7/1985 | LaBouff . | |
| 4,614,453 | 9/1936 | Tsuno et al. . | |

FOREIGN PATENT DOCUMENTS

| | | | |
|---|---|---|---|
| 95540 | 12/1983 | European Pat. Off. . | |
| 139406 | 5/1985 | European Pat. Off. . | |
| 897377 | 11/1953 | Fed. Rep. of Germany . | |
| 2457231 | 4/1976 | Fed. Rep. of Germany . | |
| 2734747 | 2/1979 | Fed. Rep. of Germany . | |
| 54-42520 | 2/1979 | Japan . | |
| 214018 | 12/1983 | Japan | 403/273 |
| 59-103902 | 6/1984 | Japan . | |
| 304836 | 4/1955 | Switzerland . | |
| 1394919 | 5/1975 | United Kingdom . | |
| 2104551 | 3/1983 | United Kingdom . | |
| 502133 | 4/1976 | U.S.S.R. . | |

OTHER PUBLICATIONS

Walzer and Langer, 687 M.T.Z. Motortechnische Zeitschrift, vol. 44 (1983), Jun., No. 6, Schwabisch Gmund Deutschland.

*Primary Examiner*—Louis J. Casaregola
*Assistant Examiner*—Timothy S. Thorpe
*Attorney, Agent, or Firm*—Parkhurst & Oliff

[57] ABSTRACT

A turbocharger for an internal combustion engine, in which the turbocharger has a turbine wheel made in one piece from a ceramic material and having an axially extending support portion which is inserted into a hollow shaft made from a metal material. The support portion of the turbine wheel has, at an end remote from the blade portions, a portion having an increased diameter and tightly fitted to the hollow shaft. An axial first annular slit is formed between the shaft and the support portion. A radial second annular slit is formed between facing surfaces of the shaft and the turbine wheel. These first and second slits are connected to each other and work to alleviate the effects of the different heat expansion coefficients of the metal and ceramic materials on the support portion of the turbine wheel.

3 Claims, 6 Drawing Figures

TURBOCHARGER FOR INTERNAL COMBUSTION ENGINE

BACKGROUND OF THE INVENTION

Field of the Invention

The present invention relates to a turbocharger for an internal combustion engine. More particularly, it relates to a construction of combined metal-ceramic turbine wheel for the turbocharger.

The turbine wheel of a turbocharger for an internal combustion engine operates under severe thermal conditions caused by contact with the extremely high temperatures of the exhaust gas from the internal combustion engine. Accordingly, the turbine wheel is usually made of a heat resistant metal material, such as Inconel. The heat resistance of such a material is, however, insufficient to fully resist these high temperatures.

To overcome this heat resistance insufficiency, it has been proposed to make the turbine wheel of a high heat resistance ceramic material. In this case, however, it is difficult to cast the turbine wheel as a one-piece unit including a shaft portion, since ceramic is fragile when subjected to a shearing force, and such a force is exerted mainly at a portion where the turbine wheel is supported in a housing. The one-piece construction is also disadvantageous from the viewpoint of cost.

In view of the above, it has been proposed to construct a turbine wheel having a turbine wheel portion made of a ceramic material and a shaft made of a metal material, as disclosed, for example, in Japanese Unexamined Patent Publication (Kokai) No. 54-42520. In this prior art, the turbine wheel made from a ceramic material is provided with a blade portion and a support portion extending axially from the blade portion. The support portion of the turbine wheel is thermally fitted inside a hollow shaft made from a metal material. This prior art, however, has a drawback in that the turbine wheel may become loose in the shaft or be damaged due to the difference in the thermal expansion coefficient between the hollow shaft made from metal and the turbine wheel made from ceramic. Namely, the highest temperature of the exhaust gas is usually transmitted to the location at which the turbine wheel is fitted to the shaft. In this case, since the thermal expansion of the metal shaft becomes greater than the thermal expansion of the ceramic turbine wheel, a linear thrust force is generated by the expansion of the hollow shaft in the axial direction, forcing the turbine wheel away from the shaft toward the exhaust gas outlet. This linear thrust force generates a shearing force at the location where the turbine wheel is inserted in the hollow shaft, causing the wheel to be loosened and displaced or damaged by uneven contact with the hollow shaft.

SUMMARY OF THE INVENTION

An object of the present invention is to provide a construction capable of securely holding the turbine wheel in the hollow shaft irrespective of the difference in the thermal expansion coefficient between the ceramic wheel and the metal shaft.

According to the present invention, a turbocharger is provided, comprising: a housing assembly; a turbine wheel arranged in the housing assembly; a compressor wheel arranged in the housing assembly; and a shaft connected at each end to the turbine and compressor wheels and rotatable in the housing assembly. The turbine wheel is made as one piece from ceramic material, and having a base portion, a plurality of angularly spaced blades on the base portion, each extending radially, and a support portion extending axially from the center of the base portion. The shaft is made from a metal material, and has an axial bore opening at one end, the support portion of the ceramic wheel being inserted in the axial bore of the shaft.

The support portion has, at an end remote from the base portion, a portion having an increased diameter which is in a tight-fit relationship with respect to the bore in such a manner that a first annular slit extending axially is formed between the outer surface of the support portion and the inner surface of the bore on the side of the increased diameter portion near the base portion and that a second annular slit extending radially is formed between the facing end surfaces of the shaft and the base portion, the first and second annular slits being connected to each other.

DESCRIPTION OF THE PREFERRED EMBODIMENTS

Figure 1:
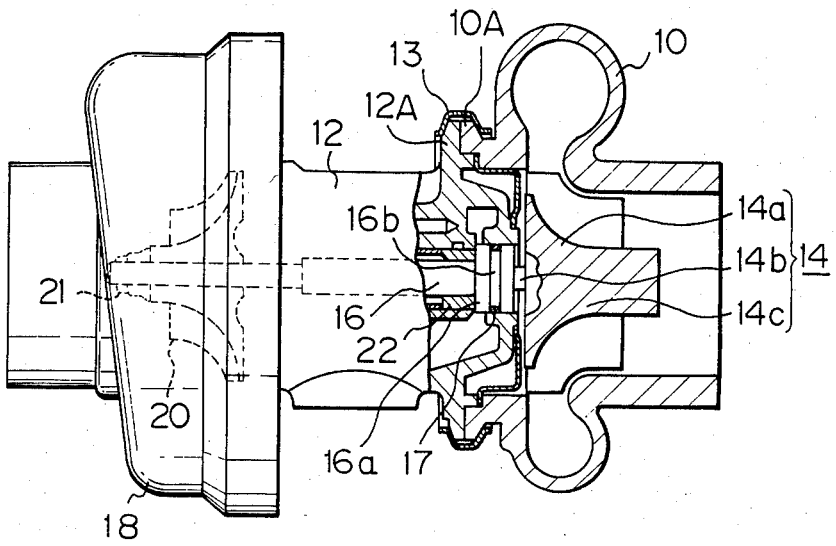
FIG. 1 is a partially cross-sectioned side view of a turbocharger according to the present invention.

FIG. 1, shows a turbocharger having a turbine housing 10 and a bearing housing 12. The housings 10 and 12 have a pair of faced flange portions 10A and 12A connected by an annular band 13 having a substantially truncated-V cross-sectional shape. A turbine wheel 14 made from a heat resistant material such as ceramic is arranged in the turbine housing 10. The turbine wheel 14 is, as will be described fully later, connected to an end of a shaft 16. A compressor wheel 20 is connected to the other end of the shaft 16 remote from the turbine wheel by means of a nut 21. The shaft 16 is connected to the bearing housing 12 by bearing units 22, one of which is shown in the drawing. The shaft 16 has on its end adjacent to the turbine wheel 14 a portion **16*a* having an enlarged diameter and defining an annular groove 16*b* opening peripherally in which a seal member such as an O-ring 17** is inserted.

Figure 2:
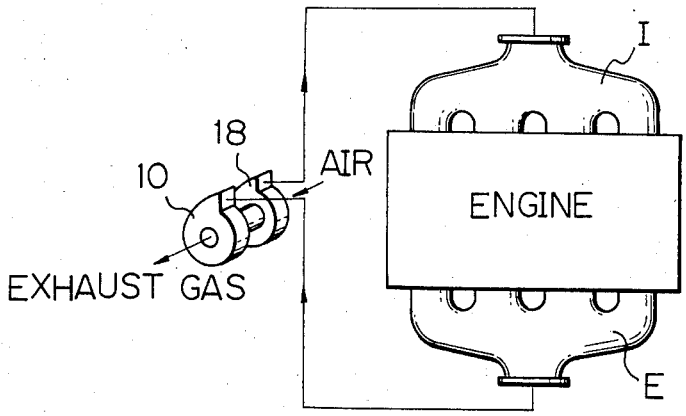
FIG. 2 is a schematic illustration of an internal combustion engine provided with the turbocharger according to the present invention.

As shown in FIG. 2, the inlet of the turbine housing 10 is connected to an exhaust manifold E of an internal combustion engine, and the outlet of the compressor housing 18 is connected to an intake manifold I. The exhaust gas from the exhaust manifold E is introduced into the turbine housing 10 to rotate the turbine wheel 14. The rotation of the turbine wheel 14 is transmitted to the compressor wheel 20 by way of the shaft 16. As a result, air is forcibly introduced into the intake manifold I.

Figure 3:
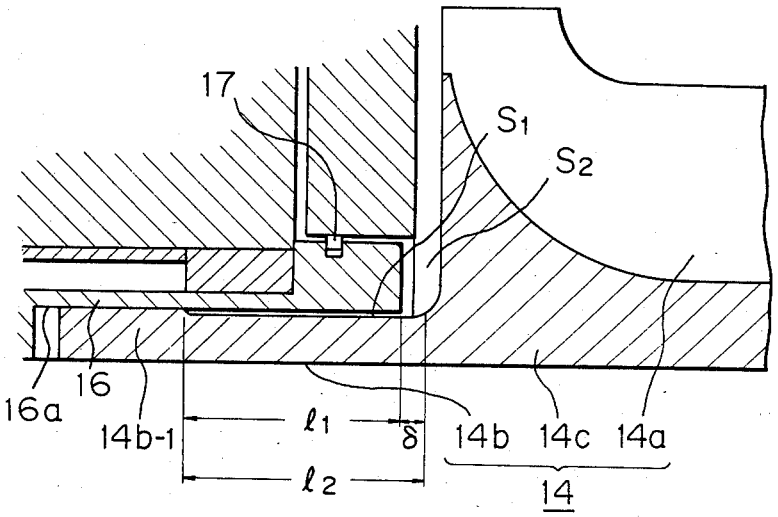
FIG. 3 is a longitudinal cross-sectional view of a turbine wheel according to the present invention.
Figure 4:
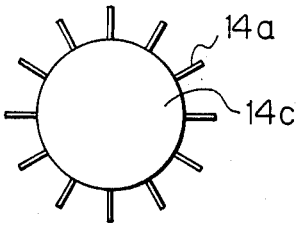
FIG. 4 is a front elevational view of the turbine wheel according to the present invention.

As shown in FIG. 3, the turbine wheel 14 is provided with a base portion **14*c*, a plurality of radial blades 14*a* circumferentially spaced, and a support portion 14*b*** extending axially from the base portion 14c in a cantilever fashion. The support portion 14b is inserted into an axial bore 16a formed inside the shaft 16. The support portion 14b has an end 14b-1 remote from the base portion 14c. Because the end portion 14b-1 fitted in the shaft 16 has an enlarged diameter, an annular slit S1 is formed between the inner surface of the bore 16a of the shaft 16 and the outer surface of the support portion 14b of the turbine wheel 14 on the side. This slit S1 extends axially from the end of the end portion 14b-1 nearest the base portion 14c to the end of the shaft 16. In addition, a second annular slit S2 is formed in a radial direction between the end surface of the blade portion 14a of the turbine wheel 14 and the end surface of the shaft 16. The diameter of the end 14b-1 is larger than that of the support portion 14b, this enlarged diameter being such that there is an interference fit or a running fit with respect to the inner surface of the bore 16a of the shaft 16. This fit relationship is tight enough to ensure that the turbine wheel 14 will not move out of the shaft 16 due to any difference in the values of thermal expansion coefficient between the shaft 16 made of metal and the wheel 14 made of ceramic when the parts 16 and 14 are subjected to the heat from the exhaust gas in the turbine housing 18, and loose enough that the turbine wheel 14 made of breakable ceramic material will not be subjected to an excessive shearing force, which force would otherwise cause the part 14 to be damaged.

Because the thermal expansion coefficient of the shaft 16 made of steel is larger than that of the turbine wheel 14 made of the ceramic material, the shaft 16 attains a thermal expansion in both the axial and radial directions when these parts 16 and 14 are subjected to the high temperature transmitted thereto by thermal conduction. According to the present invention, allowance is made for this thermal expansion in the axial and radial direction by the provision of the axial slit S1 between the support portion 14b and the shaft 16, and of the radial slit S2 between the end surfaces of the shaft 16 and the base portion 14c. This thermal expansion allowance provided by the slits S1 and S2 eliminates the generation of a shearing force at the point where the support portion 14b of the turbine wheel 14 is fitted to the hollow shaft 16, and prevents movement of the turbine wheel 14 away from the shaft 16 and subsequent damage to the wheel 14.

The axial dimension of the slit S2 must satisfy the following equation.

$$\delta \geqq l_1(1+\alpha_1 T)-l_2(1+\alpha_2 T)$$

Wherein, $l_1$ and $l_2$ represent the length from the end of the end portion 14b-1 nearest to the base portion 14c, when the end portion 14b-1 is fitted in the shaft 16, to the end of the shaft 16 when the clearance is regarded as zero and the temperature is 0° C.; $\alpha_1$ represents a thermal expansion coefficient of the shaft 16, and $\alpha_2$ a thermal expansion coefficient of the turbine wheel 14; and T represents the ambient temperature around those parts. For example, when the turbine wheel is made from $Si_3N_4$ ($\alpha_2=3.2\times10^{-6}$/° C.) and the shaft 16 is made from SCM40 ($\alpha_1=12.2\times10^{-6}$/° C.), $l_1=l_2=40$ mm, and T=500° C., then it is required that $\delta \geqq 0.18$ mm.

The dimension of the first slit S1 can be calculated in the same way.

Figure 5:
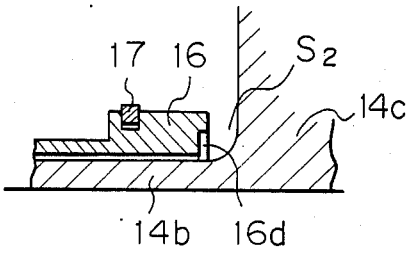
FIG. 5 is a partial view of a second embodiment of the turbine wheel according to the present invention; and, FIG. 6 is a partial view of a third embodiment of the turbine wheel according to the present invention.

In another embodiment of the present invention, as shown in FIG. 5, the end surface of the hollow shaft 16 facing the base portion 14c of the turbine wheel 14, is provided with an inner annular recessed portion 16d opening to the second slit S2. This embodiment obtains a greater allowance for heat expansion due to the larger dimension of the slit S2 between the facing end surfaces of the shaft 16 and the turbine wheel 14.

Figure 6:
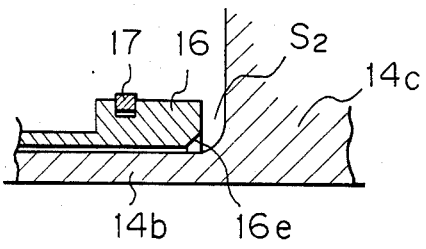

In yet another embodiment of the present invention, as shown in FIG. 6, the inner surface of the bore of the shaft 16 at an end adjacent to the base of the turbine wheel 14a has a bevelled portion 16e opening at the junction of the slit S1 and the slit S2, which bevelled portion 16e has the same effect as the recessed portion 16d shown in FIG. 5.

As will be clear from the above description, the formation of the slits S1 and S2 between the hollow shaft and the support portion of the turbine wheel, and between the hollow shaft and the base portion of the turbine wheel, permit the thermal expansion to occur freely at the area of the slits, which allows the shearing force to be eased at a position where the turbine wheel is fitted in the hollow shaft, preventing the turbine wheel from being loosened and from damage.

Furthermore, the support portion of the turbine wheel is fitted in the hollow shaft at a position remote from the blade portions of the turbine wheel, which portions are particularly subjected to a high temperature. Thus, the affect of the high temperature at that position is eased, and thermal expansion thereof becomes small when the turbocharger is operated. Therefore, even if the turbine wheel is not an absolute tight fit in the metal shaft, the turbine wheel will not become loose-fitting; this eases the labor needed to ensure an absolute tight fit for the turbine wheel in the shaft during assembly.

While the embodiments of the present invention are described with reference to the attached drawings, many modifications and changes can be made by those skilled in this art without departing from the scope and spirit of the invention.

We claim:

1. A turbocharger comprising:

a housing assembly;

a turbine wheel arranged in the housing assembly;

a compressor wheel arranged in the housing assembly; and a shaft rotatably connected in the housing assembly, one end of the shaft being connected to the turbine wheel, the other end of the shaft being connected to the compressor wheel;

said turbine wheel being made from one-piece ceramic material, and having a base portion, a plurality of angularly spaced blades on the base portion, each extending radially, and a support portion extending axially from the base portion;

said shaft being made from a metal material, and having an axial bore opening at one end, said support portion being inserted in said axial bore;

said support portion having, at an end remote from the base portion, a portion having an increased diameter which is in a tight-fit relationship with respect to the bore in order to fixedly connect the wheel to the shaft without using any additional connecting means, so that an axially extending first annular slit is formed between the outer surface of the support portion and the inner surface of the bore on the side of the increased diameter portion near the base portion; and that a second annular slit extending radially is formed between the facing end surfaces of the shaft and the base portion, the first and second annular slits being connected to each other and alone serving to allow for differential thermal expansion between the shaft and the turbine wheel.

2. A turbocharger according to claim 1, wherein said shaft has, at an end remole from the increased diameter portion, an annular inner recess opening to the second slit.

3. A turbocharger according to claim 1, wherein said shaft has, at an end remote from the increased diameter portion, an inner bevelled surface opening to said second slit.

* * * * *